US006471494B1

(12) United States Patent
Miura et al.

(10) Patent No.: US 6,471,494 B1
(45) Date of Patent: Oct. 29, 2002

(54) VACUUM PUMPING APPARATUS

(75) Inventors: Atsuyuki Miura, Aichi-ken (JP); Koichi Nakayama, Chiryu (JP); Yoshihiro Naito, Nagoya (JP); Toyoki Furuhashi, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/409,655

(22) Filed: Sep. 30, 1999

(30) Foreign Application Priority Data

Sep. 30, 1998 (JP) ..... 10-278396
Sep. 29, 1999 (JP) ..... 11-276671

(51) Int. Cl.[7] ..... F04B 17/00
(52) U.S. Cl. ..... 417/410.4; 417/354; 417/423.14
(58) Field of Search ..... 417/410.4, 423.14, 417/354, 360, 423.11; 415/90

(56) References Cited

U.S. PATENT DOCUMENTS 3,192,861 A * 7/1965 Haegh ..... 417/357
4,050,855 A * 9/1977 Sakami et al. ..... 418/131
4,272,224 A * 6/1981 Kabele ..... 417/360
5,190,438 A * 3/1993 Taniyama et al. ..... 415/90
5,267,842 A * 12/1993 Harmsen et al. ..... 417/354
5,393,201 A * 2/1995 Okutani et al. ..... 417/16
5,577,883 A * 11/1996 Schultz et al. ..... 415/90
5,616,973 A * 4/1997 Khazanov et al. ..... 310/54
5,650,676 A * 7/1997 Blumenberg ..... 310/88
5,954,489 A * 9/1999 Kinoshita ..... 418/179
6,123,516 A * 9/2000 Burghard et al. ..... 417/250
6,235,074 B1 * 5/2001 Murano et al. ..... 75/10.14

* cited by examiner

*Primary Examiner*—Charles G. Freay
*Assistant Examiner*—Michael K. Gray
(74) *Attorney, Agent, or Firm*—Oblon, Spivak, McClelland, Maier & Neustadt, P.C.

(57) ABSTRACT

A vacuum pumping apparatus includes a pump housing 1 and a motor housing 8. The housings 1 and 8 are fastened together so as to be a sealed structure by O-rings 51–58 interposed therebetween. A shaft 17 of a driving device 70 and a driving shaft 15 carrying a rotor 2*a* are detachably connected via a coupling 91. During operation of the apparatus, a rotor chamber 41 in the pump housing 1 and a motor chamber 43 in the motor housing 8 are equalized in pressure, which requires no mechanical seal therebetween. The coupling 91 facilitates easy removal or detachment of a motor part B from a pump part A, which results in convenient maintenance of the pump part A.

6 Claims, 4 Drawing Sheets

VACUUM PUMPING APPARATUS

BACKGROUND OF THE INVENTION

1. Field of the Invention

The present invention is directed to a vacuum pumping apparatus.

2. Description of the Related Art

As a conventional vacuum pumping apparatus, a roots-type vacuum pumping apparatus is shown in FIG. 4. This conventional roots-type vacuum pumping apparatus includes a pair of intermeshed rotors 21*a* and 21*b* which rotate with a fixed phase difference maintained therebetween. When the rotors rotate, a gas is sucked into an inlet port (not shown) and is discharged from an outlet port (not shown) to create a vacuum. The rotors 21*a* and 21*b* are fixedly mounted on a driving shaft 29 and a driven shaft 30, respectively. The output shaft of a driving motor 24 is connected to a synchronizing gear 22*a* which is in meshing engagement with another synchronizing gear 22*b*. The synchronizing gear 22*b* is also in meshing engagement with a third synchronizing gear 22*c*. The synchronizing gear 22*b* is mounted to one end portion of the driving shaft 29, while the synchronizing gear 22*c* is mounted to one end portion of the driven shaft 30. Thus the driving force of the motor 24 is transmitted to the rotor 21*a* by way of the synchronizing gears 22*a*, the synchronizing gear 22*b* meshed therewith and the driving shaft 29 coupled thereto, thereby rotating the rotor 21*a*. Concurrently, the driving force transmitted to the synchronizing gear 22*b* is also fed to the rotor 21*b* by way of the synchronizing gear 22*c* meshed with the synchronizing gear 22*b* and the driven shaft 30, thereby rotating the rotor 21*b*. Due to the fact that the synchronizing gear 22*b* and the synchronizing gear 22*c* are meshed with each other, the rotor 21*a* is brought into synchronization with the rotor 21*b*, thereby establishing concurrent rotations of the rotors 21*a* and 22*b* with a fixed phase difference kept therebetween.

A lower portion of the synchronizing gear 22*c* is in a lubricating oil bath 25, and the lubricating oil 25 adhered to the synchronizing gear 22*c* is applied to the synchronizing gears 22*b* and 22*a* while the synchronizing gears 22*a*, 22*b* and 22*c* are in concurrent rotation, which ensures lubricating and cooling of the synchronizing gears 22*a*, 22*b* and 22*c*. In addition, for preventing the lubrication oil 25 from entering the pump housing 26, an oil seal member 28 is provided between the rotor 21*a* and the synchronizing gear 22*b*, and between the rotor 21*b* and the synchronizing gear 22*c*.

A mechanical seal mechanism 23 is also placed between the motor 24 and gear chamber 27, and the driving force transmitting path passes through the seal mechanism 23. While the synchronizing gears 22*a*, 22*b* and 22*c* are in rotation, the gear chamber 27 accommodating the synchronizing gears 22*a*, 22*b* and 22*c* is in fluid communication with the interior of the housing 26 for the rotors 21*a* and 22*b*. As a result, both the housing 26 and the gear chamber 27 are at the low vacuum pressure. On the other hand, the motor 24 and its related portions are at atmospheric pressure. Thus, the mechanical seal mechanism 23 must prevent the atmospheric pressure from leaking into the gear chamber 27 and the housing 26.

In detail, the mechanical seal mechanism 23 includes a rubber member through which the output shaft of the motor 24 passes and an oil film extending between the rubber member and the output shaft of the motor 24. This means that the oil establishes a boundary lubrication condition between the rubber member and the output shaft of the motor 24, and the boundary lubrication condition assures the foregoing sealing function.

However, the mechanical seal mechanism 23 is relatively high in production cost. In addition, a small amount of gas leakage is inevitable in the mechanical seal mechanism 23, which results in air or atmospheric pressure leaking into the chamber 27 and the housing 26 in which the rotors 21*a* and 21*b* are accommodated, thereby lowering the vacuum producing ability of the vacuum pumping apparatus.

Japanese Patent Laid-open Publication No. Hei. 4 (1992)-31690 also discloses a vacuum pumping apparatus which is s similar to the above-described apparatus in concept, but is different therefrom in the number of synchronizing gears.

SUMMARY OF THE INVENTION

It is therefore a principal object of the present invention to provide a vacuum pumping apparatus without the foregoing drawbacks.

In order to attain the above and other objects, a vacuum pumping apparatus such as a pulse tube refrigerator includes a pump part including a pump housing, a pair of intermeshed rotors inside the pump housing, a pair of synchronizing gears for maintaining a phase difference between the rotors at a fixed value, the synchronizing gears meshed with each other and lubricated by oil, and an oil seal member preventing entry of the oil into the pump housing; and a motor part which is in the form of a sealed structure and is connected to the pump part in fluid-tight manner.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE PREFERRED EMBODIMENTS

Figure 1:
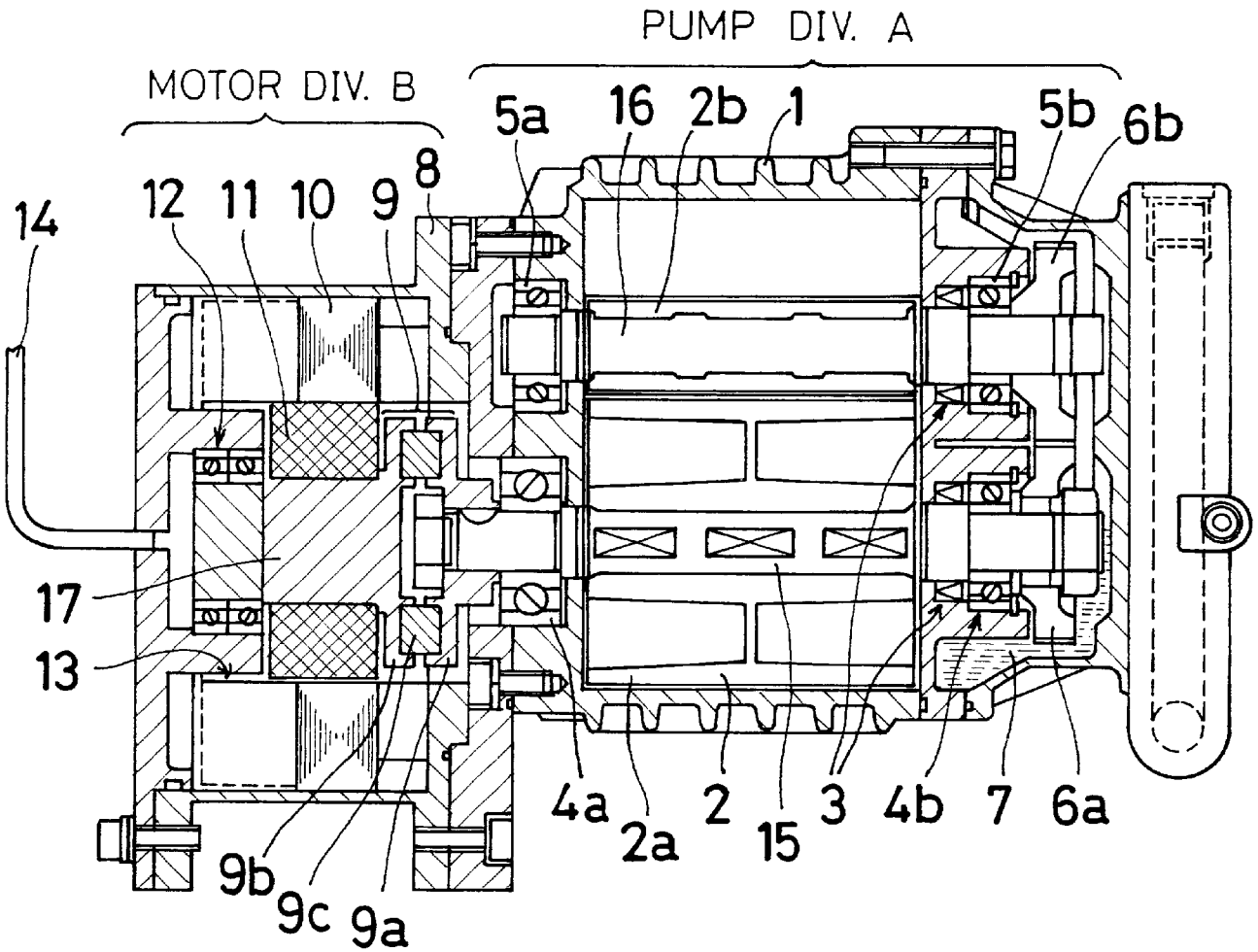
FIG. 1 is a cross-sectional view of a first embodiment of a vacuum pumping apparatus in accordance with the present invention.

Preferred embodiments of the present invention will be described hereinafter in detail with reference to the accompanying drawings. It is to be noted that throughout the specification the same reference numerals designate the same or equivalent elements.

First Embodiment

Referring first to FIG. 1 which illustrates a vacuum pumping apparatus in accordance with a first embodiment of the present invention, the vacuum pumping apparatus includes a pumping part A which may be roots-type pump and a motor part B which drives the pumping part A. The pumping part A has a pump housing 1, a first rotor shaft 15 rotatably mounted in the housing 1 by a pair of spaced bearings 4*a* and 4*b*, a second rotor shaft 16 rotatably mounted in the housing 1 in parallel to the shaft 16 by a pair of spaced bearings 5*a* and 5*b*. A pair of intermeshed rotors 2*a* and 2*b* are respectively fixedly mounted on the shafts 15 and 16 with a phase difference of 90 degrees. A pair of meshing synchronizing gears 6*a* and 6*b* are respectively mounted to the rotor shafts 15 and 16 and rotate in opposite directions to maintain the phase difference of the rotors. An oil bath 7 in the bottom of the housing 1 lubricates and cools the synchronizing gears 6*a* and 6*b*. Oil seal members 3 surrounding the shafts 15 and 16 prevent air from entering the interior of the pump housing 6.

The motor part B has a motor housing 8 which houses a motor rotor 11 whose rotor 17 is provided with a coupling 9. A bearing 12 supports a left end portion of the rotor 17. The motor stator 10 is formed as a molded structure by using a molding material 13 such as an unsaturated polyester resin. Such molding of the stator 10 by the molding material 13 ensures that the motor part B is free from damage from corona charging. The interior of the motor part B is hermetically sealed by being coupled to the pumping part A in a fluid-tight manner, for example by using an O-ring seal at facing surfaces of the motor housing 8 and the pump housing 1.

The coupler 9 which couples the rotor 17 to the driving shaft 15, has a flange 9*a*, a flange 9*b* opposed thereto in a spaced manner and is formed integrally with the right end of the rotor 17. A sleeve 9*c* connects the flanges 9*a* and 9*b* in such a manner that opposite ends of the sleeve 9*c* engage both of the flanges 9*a* and 9*b* in male-and-female fitting manner. Employing such a coupling promotes easy separation of the motor part B from the pumping part A when, e.g., overhauling the vacuum pumping apparatus.

A purge gas conduit 14 extends to a space within the motor which is next to the bearing 12 in the motor housing 8. The conduit 14 is used to introduce an inert gas such as nitrogen inside the housing 8 of the motor part B while the rotors 2*a* and 2*b* are in rotation. The introduced inert gas proceeds through the bearing 12 and a gap between the rotor 11 and the stator 10, and reaches the interior of the pumping part A in which the rotors 2*a* and 2*b* are in rotation. The resulting gas pressure prevents the invasion of condensable gas into the housing 8, which may be used in a CVD process of semiconductor manufacturing. The inert gas has an additional function of cooling the heat producing motor part B.

Second Embodiment

Figure 2:
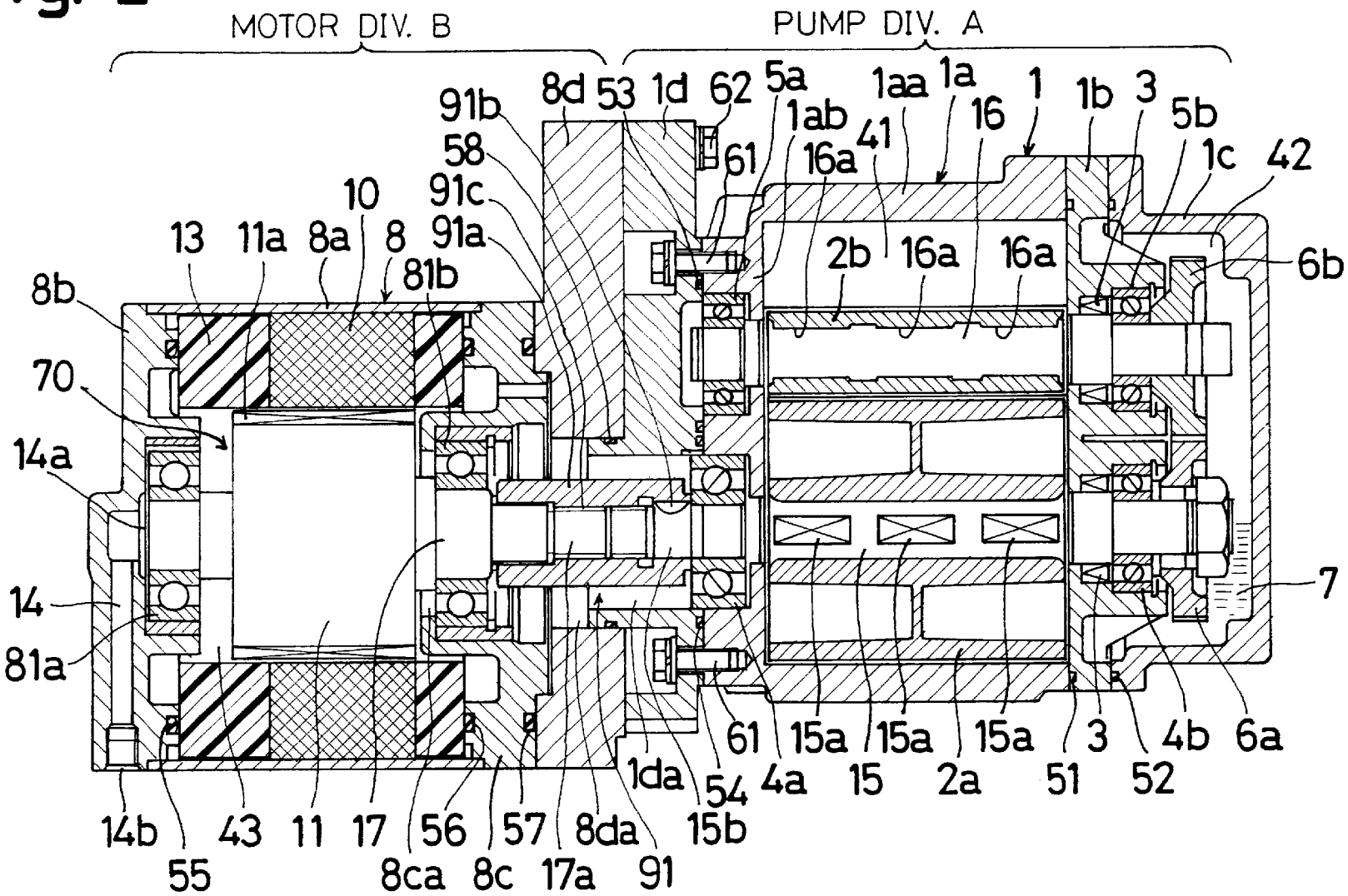
FIG. 2 is a cross-sectional view of a second embodiment of a vacuum pumping apparatus in accordance with the present invention.

Next, with reference to FIG. 2 which illustrates a vacuum pumping apparatus in accordance with a second embodiment of the present invention, the vacuum pumping apparatus includes a pumping part A which may be a roots-type pump and a motor part B which drives the pumping part A.

The pumping part A has a pump housing 1 in which are accommodated a pair of inter-meshed rotors 2*a* and 2*b*, hereinafter a driving rotor and a driven rotor, respectively. The motor part B has a motor housing 8 and a driving means 70 which is accommodated in the motor housing 8 for driving or rotating the rotors 2*a* and 2*b*.

The pump housing 1 is divided into a first part 1*a*, a bearing member 1*b* placed at a right side of the first part 1*a*, a second part 1*c* positioned at a right side of the bearing member 1*b* and a pump-side flange 1*d*. The first part la and the bearing member 1*b* define therebetween a closed space which is a rotor chamber 41, while the bearing member 1*b* and the second part 1*c* define therebetween a closed space which is a gear chamber 42.

Figure 3:
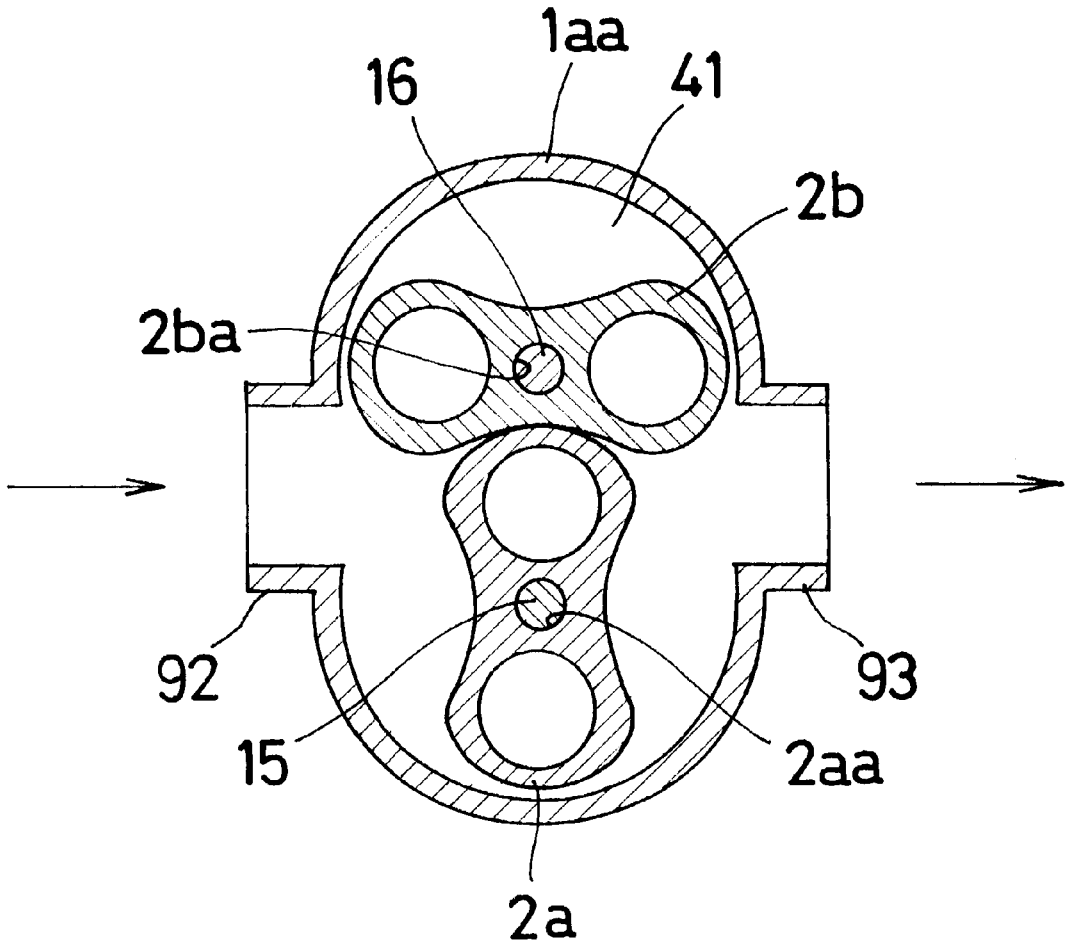
FIG. 3 shows a rotor arrangement in the vacuum pumping apparatus shown in FIG. 2.

Within the rotor chamber 41 are installed the driving rotor 2*a* and the driven rotor 2*b*. As shown in FIG. 3 which illustrates a front sectional view of the intermeshed state of the rotors 2*a* and 2*b*, the rotors 2*a* and 2*b* are set at a phase difference of 90 degrees.

The driving rotor 2*a* has at its center an axially extending bore 2*aa* through which a driving shaft 15 is passed. The driven rotor 2*b* also has at its center portion an axially extending bore 2*b* a through which a driven shaft 16 is passed. As can be understood from the illustration in FIG. 2, the driving shaft 15 and the driven shaft 16 are connected to the rotors 2*a* and the rotor 2*b*, respectively, for example by means of casting.

As apparent from the depiction in FIG.2, the first part 1*a* of the pump housing 1 has a main portion 1*aa* and a left wall portion lab formed integrally with a left side of the main portion 1*aa* to close the same. The main portion 1*aa* has a racetrack shape outer configuration, and an inner profile of the main portion 1*aa* is shaped to establish a pumping function when the rotors 2*a* and 2*b* are rotated in concurrence, as is well known. The left wall portion lab has fitted therein a driving side bearing 4*a* and a driven side bearing 5*a*, coaxial with the driving shaft 15 and the driven shaft 16, respectively. On the other hand, another driving side bearing 4*b* and another driven side bearing 5*b* are fitted in the bearing member 1*b* which closes a right side opening of the main portion 1*aa*, coaxial with the respective shafts 15 and 16. The driving shaft 15 is rotatably supported at its opposite ends at the bearings 4*a* and 4*b*, while the driven shaft 16 is rotatably supported at its opposite ends by the bearings 5*a* and 5*b*. It is to be noted that reference numeral 3 denotes an oil seal mechanism.

The right end of the driving shaft 15 extends into the gear chamber 42 after passing through the driving side bearing 4*b* and is coupled to a synchronizing gear 6*a*, while the right end of the driven shaft 16 extends into the gear chamber 42 after passing through the driving side bearing 4*b* and is coupled to a synchronizing gear 6*b*. The synchronizing gears 6*a* and 6*b* are in meshing engagement with each other, which permits concurrent or synchronized rotations of the rotors 6*a* and 6*b* with a 90 degree phase difference.

In the gear chamber 42, a lubrication oil bath 7 lubricates the engagement between the gears 6*a* and 6*b*. Even if the oil passes through the bearings 4*b* and 5*b*, the oil seal mechanism 3 prevents entry of the lubrication oil into the rotor chamber 41.

The first part 1*a*, the bearing member 1*b* and the second part 1*a* are fastened together by a suitable connectors such as a plurality of bolts (not shown). An O-ring 51 is provided at a butting joint between opposing faces of the main portion 1*aa* of the first part 1*a* and the bearing member 1*b* in order to prevent entry of external gas into the rotor chamber 41. Similarly, an O-ring 52 is provided at a butting joint between opposing faces of the bearing member 1*b* and the second part 1*c* in order to prevent entry of external gas into the gear chamber 42.

The pump-side flange 1*d* is formed at its central portion with a hole 1*da* through which a coupling 91, which will be detailed later, is passed and opens to the left side wall lab of the pump housing 1*a*. In addition, at a butting joint between opposing faces of the pump-side flange 1*d* and the left side wall lab, there are provided O-rings 53 and 54 for the prevention of an introduction of external gas through the butting joint and bearings 4*a* and 5*a* into the rotor chamber 41.

Thus, the O-rings 51, 52, 53 and 54 make the pump housing 1 a sealed structure and ensure that no external gas enters the pump housing 1.

The motor housing 8 has a cylindrical portion 8*a* whose opposite ends are open, a left wall member 8*b* closing a left side of the cylindrical portion 8*a*, a right wall member 8*c* positioned at a right side of the cylindrical portion 8*a* and provided with a hole 8*ca* through which a rotor shaft 17 of a motor 70 as a driving means which will be detailed later, and a motor-side flange 8*d* connected to a right end of the cylindrical portion 8*c* and provided with a hole 8*da* through which the coupling 91 passes. The cylindrical portion 8*a,* the left side wall 8*b,* the right side wall 8*c* and the motor-side flange 8*d* are fastened together by connecting elements such as a plurality of bolts (not shown), to define a motor chamber 43 in which the driving mean 70 is accommodated.

In this embodiment, the driving means 70 is in the form of an electric motor which has the rotor shaft 17, a cylindrically-shaped rotor 11 which is coupled to the shaft 17 in a coaxial manner, and a ring-shaped motor stator 10. On the rotor 11 there is fixedly mounted a ring-shaped permanent magnet 11*a,* and the motor stator 10 is positioned around the permanent magnet 11*a* in such a manner that a clearance is defined therebetween.

In the left side wall 8*b* of the motor housing 8 there is fitted a bearing 81*a* coaxial with the shaft 17 of the motor, while in the right wall 8*c* of the motor housing 8 there is fitted a bearing 81*b* coaxial with the shaft 17. Thus the motor shaft 17 is rotatably supported by the bearings 81*a* and 81*b* between which the motor is placed.

The motor stator 10 forms a molded structure by a molding material 13 such as a resin. Molding the stator 10 by the molding material 13 ensures that the motor part B will not be damaged by corona charging.

The left wall 8*b* of the motor housing 8 is provided with a passage or line 14 in such a manner that one end 14*a* of the line 14 opens at an right side of the left wall 8*b,* while the other end 14*b* opens at an outer side of the left wall 8*b* and is in connection with a purge tank (not shown).

At an abutting joint of opposing faces of the left wall 8*b* of the motor housing 8 and the molding material 13, there is provided an O-ring 55 to prevent entry of external gas into the motor chamber 43. Similarly, at a butting joint of opposing faces of the right wall 8*c* of the motor housing 8 and the molding material 13, there is provided an O-ring 56 to prevent entry of external gas into the motor chamber 43 by way of the abutting joint. Likewise, at a butting joint of opposing faces of the right wall 8*c* of the motor housing 8 and the motor-side flange 8*d,* there is provided an O-ring 57 to prevent entry of external gas into the motor chamber 43 by way of the abutting joint. Thus the O-rings 55, 56 and 57 seal the motor housing 8 to ensure that no external gas enters the motor housing 8.

The pump-side flange 8*d* and the motor-side flange 1*d* between which an O-ring 58 is interposed are connected by a plurality of bolts 62 (only one is shown). The O-ring 58 prevents entry of external gas into the rotor chamber 41 and the motor chamber 43 by way of the bearing 4*a* and the bearing 91*b,* respectively.

The shaft 17, after passing through the hole 8*ca* in the right wall 8*c,* is rotatably supported by the bearing 81*b* and terminates in a connection with the coupling 91 which extends in the hole 8*da* of the motor-side flange 8*d* and the hole 1*da* of the pump-side flange 1*d*.

The coupling 91 has a main body 91*a* which is in the form of a hollow cylindrical structure and has an inward projection which is of a semicircular shape in cross-section. The main body 91*a* is provided at its inner surface with an inner spline 91*c*. On the other hand, the shaft 17 decreases its radius toward its right end in stepwise manner and is provided on its outer surface with an outer spline part 17*a* which is in engagement with the inner spline 91*c*. In addition, the left end of the driving shaft 15 extends, after passing through the bearing 4*a,* inside the coupling 91. A portion other than the extending portion 15*b* of the driving shaft 15 is provided partly with a key groove (not referenced) with which the semi-circular projection 91*b* engages. Thus the rotation of the shaft 17 of the motor 7 is transmitted to the main portion 91*a* which is in spline engagement with the shaft 17, which causes rotation of the driving shaft 15 which is in key-and-groove engagement with the main portion 91*a*.

It is to be noted that as illustrated in FIG. 3, the main portion 1*aa* of the first part 1*a* of the pump housing 1 is provided with an inlet port 92 and an outlet port 93. The inlet port 92 is in fluid communication with a chamber (not shown) to be evacuated and is set to receive a gas to be fed to the rotor chamber 41, while the outlet port 93 is used to discharge the gas in the rotor chamber 41.

In operation, once electric power is applied from a power source (not shown), the rotor 11 begins to rotate. The resultant rotation is transmitted to the shaft 17, thereby rotating the shaft 17, and so is transmitted to the main body 91*a* of the coupling 91 which results from the spline connection between the shaft 17 and the main body 91*a* of the coupling 91. The resultant rotation is then transmitted to the driving shaft 15 due to the fact that the main body 91*a* of the coupling 91 is in engagement with the driving shaft 15 in a key-and-groove manner. Then, the synchronizing gear 6*a* causes a concurrent rotation of the synchronizing gear 6*b* which is in meshing engagement with the synchronizing gear 6*a*. Due to the fact that the synchronizing gear 6*b* is connected to the driven shaft 16, the driving shaft 15 and the driven shaft 16 are in synchronized rotation. Thus, the driving rotor 2*a* and the driven rotor 2*b* are rotated in opposite directions. The resultant synchronized rotations of the intermeshed rotors 2*a* and 2*b* sucks gas into the rotor chamber 41 via the inlet port 92 and discharges the gas outside the apparatus from the rotor chamber 41 via the outlet port 93, which establishes an evacuated condition in the chamber associated with the inlet port 92.

During this time, due to the O-rings 51, 52, 53, 54, 55, 56, 57 and 58, the space including the rotor chamber 41 and the gear chamber 42 of the pump housing 1, and the interior of the motor chamber 43 of the motor housing 8 are isolated from the atmosphere, and the pump housing 1 and the motor housing 8 having such sealed spaces are fastened together.

In addition, the rotor chamber 41 in the pump housing 1 is in fluid communication with the motor chamber 43 in the motor housing 8 by way of the bearing 4*a,* hole 1*da* in the pump-side flange 1*d,* the hole 8*da* in the motor-side flange 8*d* and the bearing 81*b,* which enables an equalization in pressure between the rotor chamber 41 and the motor chamber 43. Further, the O-rings 51 to 56 prevent invasion of external gas into the chambers 41 and 43. Thus, during the operation of the vacuum pumping apparatus the pressure in the rotor chamber 41 is kept equal to the pressure in the motor chamber 43, which means that no pressure sealing is required for the separation of the chambers 41 and 43. By avoiding a mechanical seal member of high cost, the vacuum pumping apparatus may be made at lower cost.

Moreover, during operation of the vacuum pumping apparatus, a purge gas is supplied from the purge gas tank to the line 14. The purge gas flows through the bearing 81*a* and/or a gap between the bearing 81*a* and the shaft 17 of the motor 7, a left-side space of the motor chamber 43, a gap between the motor rotor 11 and the motor stator 10, and a right-side space of the motor chamber 43. The purge gas reaching the motor chamber 43 moves into the rotor chamber by way of the hole 8*ca* in the right wall member 8*a,* the bearing 81*b,* and the hole 8*da* in the motor-side flanges 8*d*. Then, the purge gas is discharged out of the rotor chamber 41.

Forming or generating such a purge gas stream or current which moves or flows from the motor chamber 43 into the rotor chamber 41 enables the prevention of entry of impurities from the side of the rotor chamber 41 to the side of the motor chamber 43. For example, in semiconductor production process, the chemical vapor deposition (CVD) is executed in a chamber which is to be evacuated by vacuum pumping. During execution of the CVD, generation of impurities is inevitable, which causes entry of such impurities into a device for vacuum pumping. However, if the device for vacuum pumping is the apparatus according to the present invention, the impurities are discharged from the outlet 93, and so the purge gas stream prevents entry of the impurities into the motor chamber 43. Thus damage and/or corrosion of the driving means 70 can be prevented. In addition, the heat generated within the motor portion which is in a sealed state can be cooled down by the purge gas stream.

The inert gas may be nitrogen or any other inert gas or any gas which does not react with the gas to be sucked into the rotor chamber 43, or the impurities contained in the gas.

When maintenance such as an overhaul or cleaning of the rotor chamber 41 is required, and/or when the pump portion PA is replaced with a new one, no work has to be made other than loosening the bolts 62 which separate the motor-side flange 8*d* and the pump-side flanges 1*d*. Upon separation of the motor-side flange 8*d* and the pump-side flange 1*d*, the connection of the motor part B and the pump part A is maintained only by the spline connection between the inner spline portion 91*c* of the coupling 91 and the outer spline portion of the shaft 17, with the result that moving or transferring the motor part B in the leftward direction in FIG. 2 releases the spline connection, thereby permitting an easy removal of the motor part B from the pump part A. Thus, the detachable connection of the driving means 70 to the driving shaft 15 via the coupling 91 permits an easy separation of the pump part A and the motor part B, to enable easy maintenance and replacement of the pump part A.

As mentioned above, in accordance with the present embodiment, the vacuum pumping apparatus includes the pump part A having the pump housing 1 in which the pair of intermeshing or driving and driven rotors 2*a* and 2*b* are accommodated and the motor part B having the driving means 70 for the rotors 2*a* and 2*b*, respectively, wherein the pump housing 1 and the motor housing 8 are combined together to establish the sealed structure by interposing therebetween the O-rings 51 to 58, thereby separating the interior of the pump part A and the interior of the motor part B which includes the rotor chamber 41, the gear chamber 42, and the motor chamber 43 from the outside, with the result that the desired vacuum degree in the pump part A can be kept or maintained. Moreover, equalizing the pump part A and the motor part B pressures permits elimination of the conventionally required or essential mechanical seal.

Figure 4:
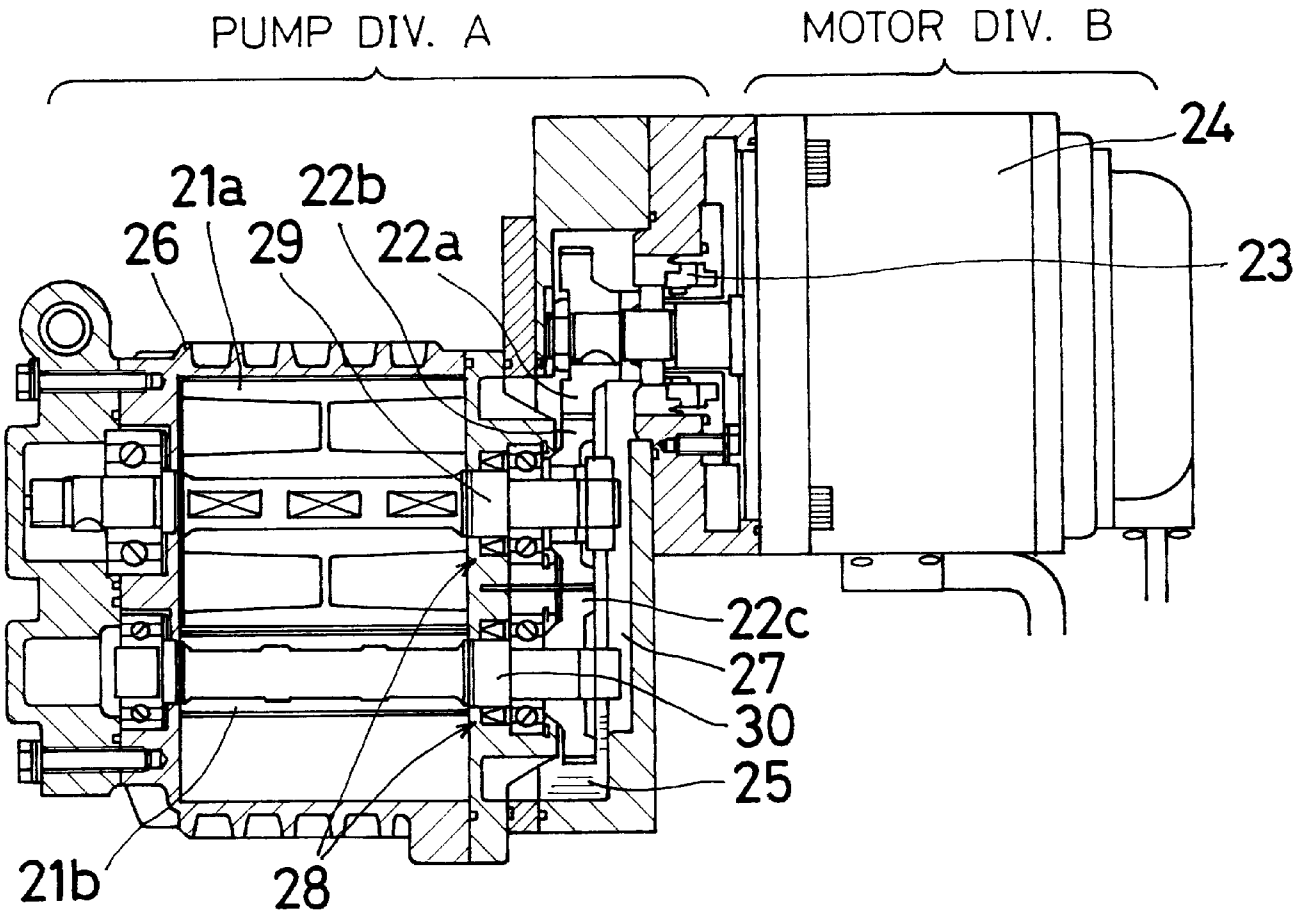
Fig. 4 (Prior Art)
FIG. 4 is a cross-sectional view of a conventional a vacuum pumping apparatus.

In addition, the detachable connection of the shaft 17 of the driving means 70 by way of the coupling 91 to the driving shaft 15 rotating the rotor 2*a* enables easy removal of the motor part B from the pump part A when the pump part A is replaced with a new one or is required to be maintained. Moreover, coupling 91 makes a direct connection of the driving means 70 and the driving rotor 2*a*, resulting in an elimination of the synchronizing gear 22*a* as shown in FIG. 4, which is an essential element of the conventional apparatus.

The spline connection between the shaft 17 of the driving means 70 and the coupling 91 enables easy removal of the driving means 70 from the coupling 91 by transferring the shaft 17 in the leftward direction in FIG. 2, thereby simplifying detachment and mounting of the motor part B.

Furthermore, in the present embodiment, the driving means 70 is designed to include the motor shaft 17 connected to the driving rotor 2*a* via the coupling 91 and the motor stator 10 arranged around the motor rotor 11, and is connected to the molded structure with the molding material 13, which can prevent damage to the motor part B from corona charge.

Moreover, providing the purge gas line 14 in the left wall member 8*b* of the motor housing 8 to supply the purge gas inside the motor part B can prevent invasion of impurities from the pump part A to the motor part B, thereby preventing damage and corrosion of the motor part B caused by the impurities. The purge gas also has a function to reduce the internal heat generated in the sealed inner space of the motor part B.

Advantages of the Present Invention

As apparent from the foregoing explanation, the present invention offers a vacuum pumping apparatus which eliminates the conventional high cost mechanical seal, which means that such a pump can be made at lower cost. In addition, the detachable connection of the driving means of the motor part and the rotor of the pump part by the coupling enables easy removal or detachment of the motor part from the pump part, thereby establishing convenient maintenance and/or replacement of the pump part.

The invention has thus been shown and description with reference to specific embodiments, however it should be understood that the invention is in no way limited to the details of the illustrated structures but changes and modifications may be made without departing from the scope of the appended claims.

What is claimed is:

1. A vacuum pumping apparatus comprising:

a pump part including a pump housing having a rotor chamber, a pair of intermeshed rotors inside the rotor chamber, a pair of oil lubricated meshing synchronizing gears mounted for maintaining a phase difference between the rotors and an oil seal member positioned to prevent entry of the oil into the pump housing;

a sealed motor part having a motor chamber, connected to the pump part in fluid-tight manner; and a purge gas line connected to the motor part for supplying a purge gas inside the motor part, wherein the rotor chamber is in fluid communication with the motor chamber, whereby a pressure in the rotor chamber is maintained equal to the pressure in the motor chamber during operation of the vacuum pumping apparatus.

2. A vacuum pumping apparatus comprising:

a pump part including a pump housing having a rotor chamber and at least one rotor accommodated in the rotor chamber;

a motor part including a motor housing including a motor chamber, and a motor accommodated in the motor housing and rotatably connected to the at least one rotor, wherein the motor housing is fluid tightly connected to the pump housing; and a purge gas line connected to the motor part for supplying a purge gas inside the motor part, wherein the rotor chamber is in fluid communication with the motor chamber, whereby a pressure in the rotor chamber is maintained equal to the pressure in the motor chamber during operation of the vacuum pumping apparatus.

3. A vacuum pumping apparatus as set forth in claim 2, wherein the motor includes a motor rotor, as said rotor, connected to the motor shaft and a motor stator arranged around the motor rotor and formed into a molded structure by a molding material.

4. A vacuum pumping apparatus comprising:

a pump part including a pump housing having a rotor chamber, a pair of intermeshed rotors inside the rotor chamber, a pair of oil lubricated meshing synchronizing gears mounted for maintaining a phase difference between the rotors and an oil seal member positioned to prevent entry of the oil into the pump housing;

a motor part connected to the pump part in a fluid-tight manner, said motor part having a motor chamber fluidically communicating with the pump part, and being sealed to isolate the motor part relative to atmospheric pressure; and a purge gas line connected to the motor part for supplying a purge gas inside the motor part, wherein the rotor chamber is in fluid communication with the motor chamber, whereby a pressure in the rotor chamber is maintained equal to the pressure in the motor chamber during operation of the vacuum pumping apparatus.

5. A vacuum pumping apparatus comprising:

a pump part including a pump housing having a rotor chamber and at least one rotor accommodated in the rotor chamber;

a motor part including a motor housing having a motor chamber and a motor accommodated in the motor chamber and rotatably connected to the at least one rotor, wherein the motor housing is fluid tightly connected to the pump housing, and is fluidically communicating with the pump part and sealed to isolate the motor part relative to atmospheric pressure; and a purge gas line connected to the motor part for supplying a purge gas inside the motor part, wherein the rotor chamber is in fluid communication with the motor chamber, whereby a pressure in the rotor chamber is maintained equal to the pressure in the motor chamber during operation of the vacuum pumping apparatus.

6. A vacuum pumping apparatus as set forth in claim 5, wherein the motor includes a motor rotor, as said rotor, connected to the motor shaft and a motor stator arranged around the motor rotor and formed into a molded structure by a molding material.

* * * * *